US005950768A

United States Patent [19]

Gensike et al.

[11] Patent Number: 5,950,768

[45] Date of Patent: Sep. 14, 1999

[54] ELEVATOR SPEED REGULATING SAFETY EQUIPMENT

[75] Inventors: Karsten Gensike, Buchrain; Peter Möri, Rothenburg, both of Switzerland

[73] Assignee: Inventio AG, Hergiswil, Switzerland

[21] Appl. No.: 08/790,531

[22] Filed: Jan. 30, 1997

[30] Foreign Application Priority Data

Jan. 31, 1996 [CH] Switzerland ..... 00242/96

[51] Int. Cl.[6] ..... B66B 5/04

[52] U.S. Cl. ..... 187/376; 188/43

[58] Field of Search ..... 187/359, 373, 187/376, 371, 372; 188/43

[56] References Cited

U.S. PATENT DOCUMENTS

| | | | |
|---|---|---|---|
| 2,150,373 | 3/1939 | Hymans | 187/376 |
| 2,274,000 | 2/1942 | Sahlin | 187/376 |
| 2,716,467 | 8/1955 | Callaway | 187/376 |
| 2,719,608 | 10/1955 | Callaway | 187/373 X |
| 5,065,845 | 11/1991 | Pearson | 187/376 |
| 5,096,020 | 3/1992 | Korhonen . | |
| 5,230,406 | 7/1993 | Poon . | |
| 5,301,773 | 4/1994 | Jamieson et al. . | |
| 5,363,942 | 11/1994 | Osada . | |
| 5,366,044 | 11/1994 | Jamieson et al. . | |
| 5,370,208 | 12/1994 | De Jong | 187/376 X |

FOREIGN PATENT DOCUMENTS

| | | |
|---|---|---|
| 0440839 | 8/1991 | European Pat. Off. . |
| 0613851 | 9/1994 | European Pat. Off. . |
| 2251659 | 5/1973 | Germany . |

OTHER PUBLICATIONS

Copy of an International Search Report dated Jul. 4, 1996 and Annex.

*Primary Examiner*—Christopher P. Ellis
*Assistant Examiner*—Steven B. McAllister
*Attorney, Agent, or Firm*—Greenblum & Bernstein, P.L.C.

[57] ABSTRACT

Safety equipment, in the form of an arresting device with triggering equipment for an elevator cage, which runs in rail guides and is for the conveying of persons and/or goods, which safety equipment stops the elevator cage when the permissible speed of travel in upward direction and in downward direction is exceeded, wherein a trigger lever connected the limiter cable is effective in both directions of travel. Known arresting devices are arranged functionally mutually opposite on support brackets and a double arresting device for both directions of travel is formed in this manner. The triggering of the corresponding arresting device separately in direction of travel takes place by way of some new parts which are incorporated between the arresting devices and the known triggering system consisting of speed limiter, limiter cable with tensioning weight and trigger lever.

21 Claims, 4 Drawing Sheets

ELEVATOR SPEED REGULATING SAFETY EQUIPMENT

CROSS-REFERENCE TO RELATED APPLICATION

The present invention claims priority under 35 U.S.C. § 119 of Swiss Patent Application No. 00 242/96 filed on Jan. 31, 1996, the disclosure of which is incorporated by reference in its entirety.

BACKGROUND OF THE INVENTION

1. Field of the Invention

The present invention may be directed to safety equipment, and in particular to an arresting device with associated triggering equipment, utilized in an elevator cage running along predefined guides. The elevator cage may be used to convey persons and/or goods. The safety equipment may recognize when the elevator cage exceeds a permissible speed of travel in either an upward or downward direction, and stop the elevator cage. The safety equipment may utilize a trigger lever, connected with a limiter cable, that is effective in both directions of travel.

2. Discussion of the Background Information

Safety equipment, similar in general to the device of the present invention, protects the passengers in an elevator cage against physical injury when a permissible speed is exceeded in the upward direction, i.e., the upward case.

The prior art safety equipment constructed for the above-noted purpose consists of an arresting device, effective in both directions of travel, at the elevator cage and triggering equipment. The triggering equipment consists of a speed limiter responding in both directions of rotation, a limiter cable with a tensioning device and fracture checking equipment, and a trigger lever connected with the limiter cable at the elevator cage.

A double arresting device, having separate or connected brake chocks for each direction of travel, is disclosed in schematic illustration by European Patent Specification No. 0 440 839. The brake chocks are provided on only one side of the guide rail and, during arresting, are supported by a passive abutment plate on the other side of the guide rail. In an arresting device of this type, a transverse displaceability of the arresting device under load must be provided to enable centering of the device during an arresting operation. No solution is disclosed for this problem in the prior art. Upon triggering, the brake chock of the prior art, which does not participate in the arresting and which moves in the opposite direction of travel, is actuated in the opposite sense and is pushed out of its rest position. This result is undesirable, however, given in the prior art it was through that the constructional formation of this equipment for practical use would probably lead to a cost-intensive solution.

A double arresting device, according to U.S. Pat. No. 5,096,020, also operates with a respective chock for each direction of travel, but in an oppositely disposed arrangement. A common trigger lever engages with entraining slots in the arresting chocks. Upon triggering, this arresting device must be laterally displaced until lying against the passive chock of the opposite direction. The transverse displacement under load requires rolling friction for reliable centering, which requires a corresponding additional constructional effort.

Another double arresting device is disclosed in U.S. Pat. No. 5,230,406. In this arresting device, the arresting chocks are disposed at both sides of the guide rail and, as shown in FIGS. 6–9, each are constructed for both directions of travel, i.e., each includes a double ramp in different shapes at a rear side. During downward arresting the brake chocks are drawn into the arresting position by rods. During upward arresting, the brake chocks are pushed by the same rods into the arresting position. However the equipment requires additional equipment for practical construction, for example, specially constructed retaining springs, chock guides and adjusting devices.

The above-mentioned examples of prior art double arresting devices disclose special constructions, which entail new variants for equipment which is known in principle. However, special construction contradicts the endeavor for standardization and for reduction in diversity of parts and makes the rational application of an economical modular construction technique more difficult.

SUMMARY OF THE INVENTION

Therefore, it is an object of the present invention to provide a double arresting device ready for use and which can replace or supplement the prior art without material modification. The present invention may be provided in accordance with known and existing assemblies and may also include new parts and a new arrangement in accordance with the disclosure herein.

The above-noted drawbacks of the prior art may be overcome by the present invention which may be directed to safety equipment for an elevator cage running along at least one guide rail. The safety device utilized to stop the elevator cage when a predetermined speed of travel in one of an upward and downward direction of travel is exceeded. The safety equipment may include a trigger lever coupled to a limiter cable operable in each direction of travel; at least one double arresting device coupled to the elevator cage including a first and second arresting device operable in mutually opposite directions of travel; a first and second fastening part respectively associated with the first and second arresting device. The triggering lever may be coupled to the at least one double arresting device and may be actuatable by a predetermined relative movement between the elevator cage and the limiter cable. The safety device may also include triggering devices coupled between the trigger lever and the first and second trigger devices. The triggering devices may actuate one of the first and second triggering devices in accordance with actuation of the trigger lever.

In accordance with another feature of the present invention, the trigger devices may include a first and second entraining plate and a first and second entraining crosstie rod, in which each entraining rod may include a first and second end having an entraining pin. Each entraining pin may be in engagement with one of the first and second entraining plates. The safety device may also include at least two guide pins and respective restoring springs coupled between an arm of the first and second fastening parts.

In accordance with still another feature of the present invention, each entraining plate may include a recess having an annular segment shape that enables triggering of one of the first and second triggering devices in accordance with the direction of travel while enabling the non-triggered one of the first and second triggering devices to remain at a rest position.

In accordance with yet another feature of the present invention, the safety device may further include a first and second entraining crosstie rod having first and second ends, a first and second pullrod, and a first and second brake chock. The first and second brake chocks may be associated with a respective first and second pullrod. The safety device may also include a first and second entraining plate, a recess formed in each of the first and second entraining plates, and an entraining pin positioned at each first and second end of each first and second entraining crosstie rod.

In accordance with a further feature of the present invention, the first and second entraining crosstie rods may be biased toward a rest position through at least one restoring spring and a guide pin.

In accordance with a still further feature of the present invention, each fastening part may include an L-shaped member having an arm coupled to the elevator cage and an arm for guiding one of the first and second arresting devices toward the guide rail to stop the movement of the elevator cage.

The present invention may also be directed to safety equipment for arresting movement of an elevator cage when a speed of the elevator cage exceeds a predetermined limit. The elevator cage speed may be monitored with respect to a limiter cable. The safety equipment may include a first and second arresting device positioned for arresting movement of the elevator cage in a respective first and second direction of travel, a triggering device that actuates one of the first and second arresting device, and a trigger lever that actuates the triggering device in response to predetermined relative movement between the elevator cage and the limiter cable. The triggering device, which may include a first and second entraining crosstie, when actuated, may force the first and second entraining crossties relatively closer together and the relative closer movement of the first and second entraining crossties may direct one of the first and second arresting device to arrest movement of the elevator cage.

In accordance with a further feature of the present invention, each first and second arresting device may include a first and second arresting chock. The relative closer movement of the first and second entraining crossties may direct the first and second arresting chocks of one of the first and second arresting device to move in two dimensions.

In accordance with still another feature of the present invention, each first and second arresting device may further include a first and second fastening bracket that respectively fastens the first and second arresting devices to the elevator cage. Each fastening bracket may include a first and second elongated hole that guides the movement of the first and second arresting chocks.

In accordance with yet another feature of the present invention, each fastening bracket may include an L-shaped bracket in which a vertical arm of the L-shaped bracket may be coupled to the elevator cage and in which a horizontal arm of the L-shaped bracket includes the first and second elongated holes. Each first and second arresting device may further include a first and second pullrod respectively associated with the first and second arresting chock. The first and second elongated holes of an actuated one of the first and second arresting device may respectively guide the two dimension movement of the first and second pullrod in a direction toward each other and in a direction parallel to each other.

In accordance with a further feature of the present invention, the trigger lever may be operable in a first and a second direction. One of the two dimensions may include a direction in which the trigger lever is moved when actuated and an other of the two dimensions may include a direction in which the first and second arresting chocks are moved relatively closer to each other.

In accordance with a still further feature of the present invention, the triggering device may further include a first and second entraining plate that are immobile relative to each other and relative to the trigger lever.

In accordance with yet another feature of the present invention, the triggering device may further include a triggering shaft in which the trigger lever and the first and second entraining plates are mounted thereon.

In accordance with a still further feature of the present invention, each first and second entraining crosstie may include a first and second end, each including an entraining pin. Each first and second entraining plate may receive one of the entraining pins from each of the first and second entraining crossties, and movement of the first and second entraining plates correspondingly moves one of the first and second entraining crosstie.

In accordance with another feature of the present invention, each entraining plate may include a recess for receiving the entraining pins. Movement of the first and second entraining plates in a first direction may actuate the second arresting device and movement of the first and second entraining plates in a second direction may actuate the first arresting device.

In accordance with still another feature of the present invention, the first and second entraining crossties may be parallelly mounted for movement relative to each other.

In accordance with a further feature of the present invention, the safety device may further include a first and second fastening member parallelly mounted and immobile with respect to each other. Further, the first and second fastening members may be parallelly mounted for parallel movement relative to an actuated one of the first and second entraining crossties in response to actuation of the trigger lever.

In accordance with yet another feature of the present invention, each first and second arresting device may further include a first and second arresting chock. The parallel relative movement may guide the first and second arresting chocks associated with the actuated one in a direction opposite the direction of travel.

In accordance with yet another feature of the present invention, each first and second arresting device may further include a first and second arresting chock. The parallel relative movement may guide the first and second arresting chocks associated with the actuated one in a direction toward each other.

In accordance with a still further feature of the present invention, the safety device may further include a third and fourth arresting device positioned for arresting movement of the elevator cage in the respective first and second direction and positioned to respectively face the first and second arresting device. The device may also include a connecting rod that may couple the first and second arresting devices to the third and fourth arresting devices such that actuation of the first arresting device may substantially simultaneously actuate the third arresting device and that actuation of the second arresting device may substantially simultaneously actuate the fourth arresting device.

The present invention may include two known and available arresting devices arranged in mutually opposite directions of function and for operation in both directions of travel. These devices may be set into operation with an existing triggering system after certain modifications in accordance with the present disclosure.

Other advantages and features of the present invention may be provided in the accompanying disclosure, figures and claims.

BRIEF DESCRIPTION OF THE DRAWINGS

The present invention is further described in the detailed description which follows, in reference to the noted plurality of drawings by way of non-limiting examples of preferred embodiments of the present invention, in which like reference numerals represent similar parts throughout the several views of the drawings, and wherein.

DETAILED DESCRIPTION OF THE PREFERRED EMBODIMENTS

The particulars shown herein are by way of example and for purposes of illustrative discussion of the preferred embodiments of the present invention only and are presented in the cause of providing what is believed to be the most useful and readily understood description of the principles and conceptual aspects of the invention. In this regard, no attempt is made to show structural details of the invention in more detail than is necessary for the fundamental understanding of the invention, the description taken with the drawings making apparent to those skilled in the art how the several forms of the invention may be embodied in practice.

Figure 1:
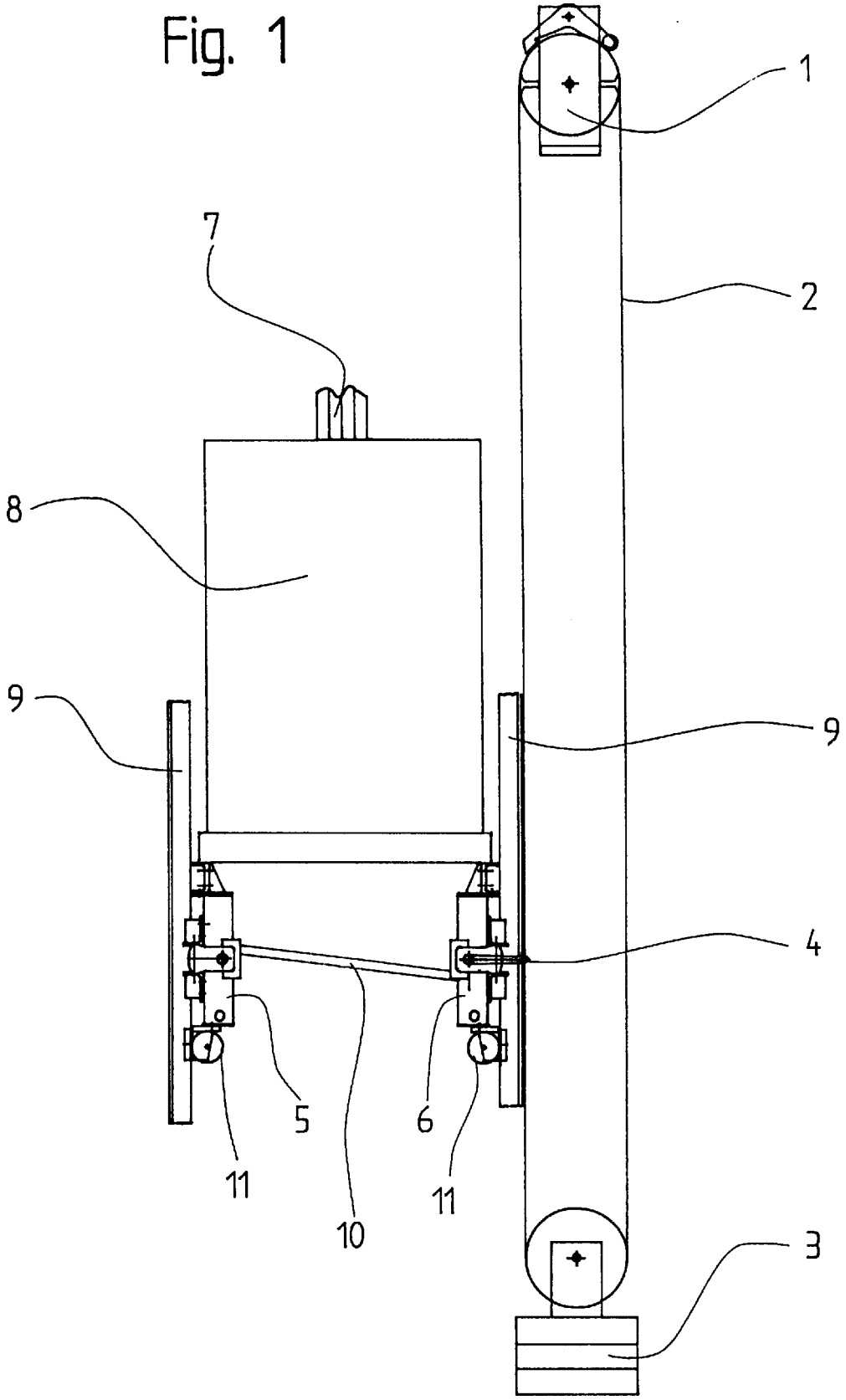
FIG. 1 shows the overall view of a passenger or goods elevator with a triggering system and double arresting device.

In accordance with FIG. 1, an elevator cage 8 may be positioned to run between and along guides 9 and may be suspended by carrying cables 7. An underside of elevator cage 8 may include an arresting device unit 5 and an arresting device unit 6. Elevator cage 8 may be located in an elevator shaft (not shown). Elevator cage 8 may be guided along guides 9 by guide rollers 11. A triggering system for arresting device units 5 and 6 may include a speed limiter 1, which responds to excessive speeds in either direction of rotation, and a limiter cable 2 with a tensioning weight 3. A trigger lever 4 coupled to arresting device unit 6 may be operatively and directly connected with limiter cable 2 and arresting device unit 6 may be operatively coupled with arresting device unit 5 through a connecting rod 10.

Figure 2:
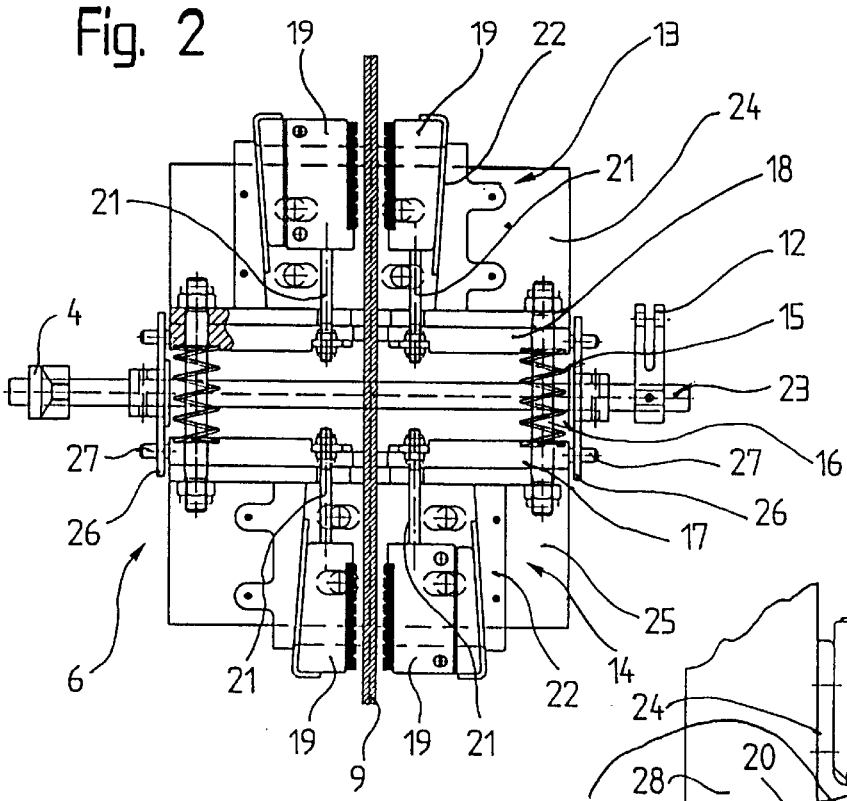
FIG. 2 shows the front elevation of the double arresting device.
Figure 3:
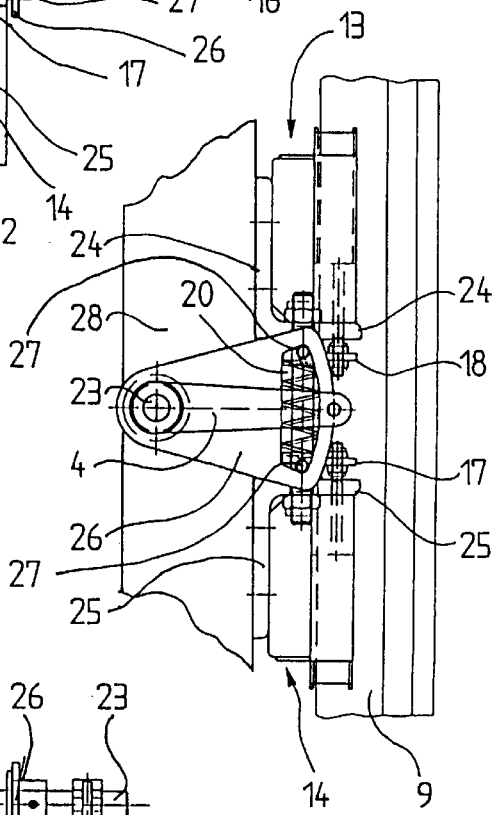
FIG. 3 shows the side elevation of the double arresting device.

In FIGS. 2 and 3, two identical, known and available arresting devices 13 and 14 may be arranged and fastened in functionally and mutually opposite directions. That is, arresting device 13 ("up" arresting device) may be positioned to arrest excessive upward movement of the elevator cage and arresting device 14 ("down" arresting device) may be positioned to arrest excessive downward movement of the elevator cage. Arresting devices 13 and 14 may be positioned on an inward side (i.e., a side facing the guide rail) of a vertically positioned arm of an upper support bracket 24 and a lower support bracket 25. The vertical arms of support brackets 24 and 25 may be firmly connected to a carrier profile section 28 located at the cage side. Each arresting device 13, 14 may include a chock box 22 and two arresting chocks 19 having pullrods 21 coupled in a usual arrangement. A lower end face of upper arresting device 13 may abut an inward side of a horizontally positioned arm of upper support bracket 24 and an upper end face of lower arresting device 14 may abut an inward side of a horizontally positioned arm of lower support bracket 25. According to this arrangement, arresting forces may be applied with friction and mechanically positive locking effects and transmitted to elevator cage 8 through a carrier profile section of a carrier device. Pullrods 21 may each be directed in an upward orientation and coupled, e.g., by a screw connection, to an entraining crosstie associated with arresting device 13 and directed in a downward orientation and coupled to an entraining crosstie rod 17 associated with arresting device 14. A rest position of brake chocks 19 can be adjusted by the screw in connection in each entraining crosstie rod. Entraining crosstie rods 17 and 18 may be guided inwardly by guide pins 16 and may be urged outwardly to a rest position against the outward side of the horizontally positioned arm of support bracket 24 and 25, respectively, by a restoring spring 15. Entraining crosstie rods 17 and 18 shown in FIGS. 2 and 3 may include two lobes, which may be reduced in thickness and still protrude forwardly somewhat. Each lobe may include an elongated hole 31 (see FIG. 4), through which pullrods 21 may be inserted. The pullrod may be secured by a screw connection through the use of two respective securing nuts. The pullrods may be displaceable with little play in a vertical direction (i.e., parallel to guide rail 9) and displaceable in a horizontal direction within the limits of elongated hole 31. Guide pins 16 may be screw-connected between the horizontal arms of support brackets 24 and 25 to form parallel mechanical connections of support brackets 24 and 25. Each end face of entraining crosstie rods 17 and 18 may include an entraining pin 27 coupled in operative connection with an entraining plate 26. Entraining plate 26 may have an annular segment shape and may include a recess 20, e.g., a perforated opening, positioned along an outer rim of the annular segment and covering about 90 percent of the annular segment angle. Thus, the perforated opening has a sufficient length and arrangement to receive and entrain (i.e., move) entraining crossties 17 and 18 via their respective entraining pins 27. Entraining plates may be arranged adjacent the outer sides of each entraining crosstie rod 17, 18 and may be firmly coupled to triggering shaft 23. Triggering shaft 23 may be coupled to trigger lever 4 at a first end and to a connecting lever 12 at a second end. Connecting lever 12 may be articulately coupled with connecting rod 10 (see FIG. 1) and may produce an operative connection between arresting device unit 6 and arresting device unit 5. Triggering shaft 23 may be rotatably mounted in a support profile section 28, which may be part of a non-illustrated cage-carrying unit. The shape of recess 20 located within entraining plate 26 may be visible in the side elevation illustrated in FIG. 3. Entraining pins 27 may penetrate recess 20 and may be located, by their cylindrical outer surfaces, in a rest position that may be substantially free of play, i.e., entraining pins 27 abut the upper and lower inside rim of recess 20. The two entraining plates 26 have the same angular position relative to each other and to trigger lever 4.

Figure 4:
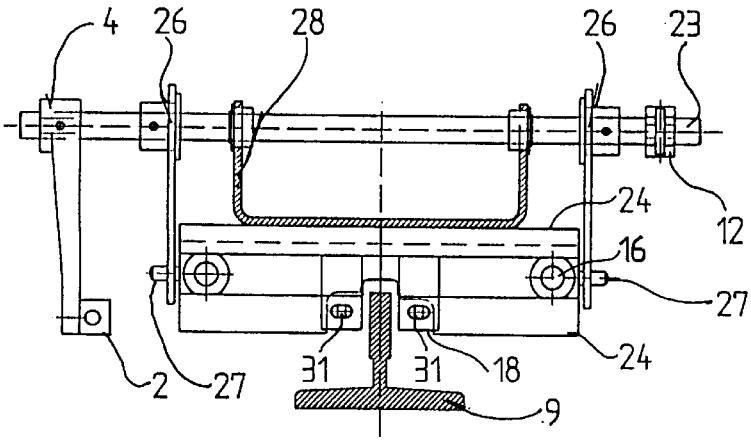
FIG. 4 shows the double arresting device in plan view.

In FIG. 4, the shape of the aforementioned elongated holes 31 in the protruding lobes of entraining crosstie rods 17 and 18 may be more clearly illustrated. Further, a friction-locking hinged connection with limiter cable 2 at the radial end of trigger lever 4 may be shown. Moreover, the arrangement of trigger lever 4, entraining plates 26 may be positioned adjacent the outer sides of entraining crosstie rods 17 and 18 and connecting lever 12 may be coupled to triggering shaft 23 and arranged to be approximately 90° offset from trigger lever 4 (and entraining plates 26). Support profile 28 is also illustrated and may show an exemplary manner for mounting the arrangement according to the present invention.

Figure 5:
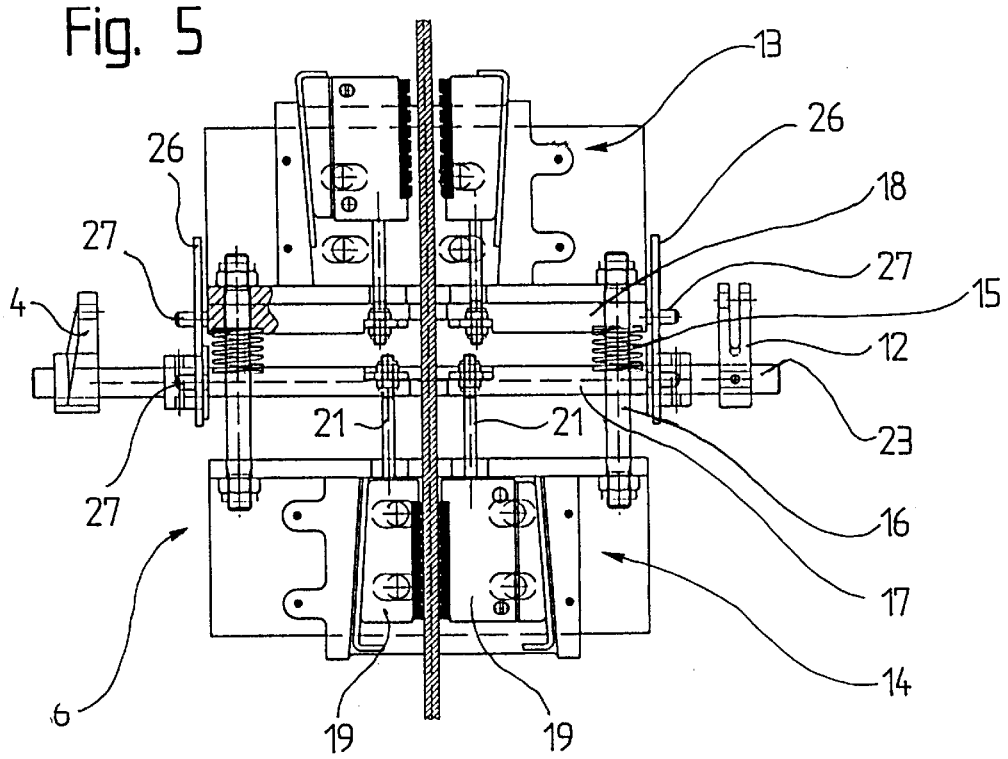
FIG. 5 shows the front elevation of the double arresting device in the triggered state in downward direction.
Figure 6:
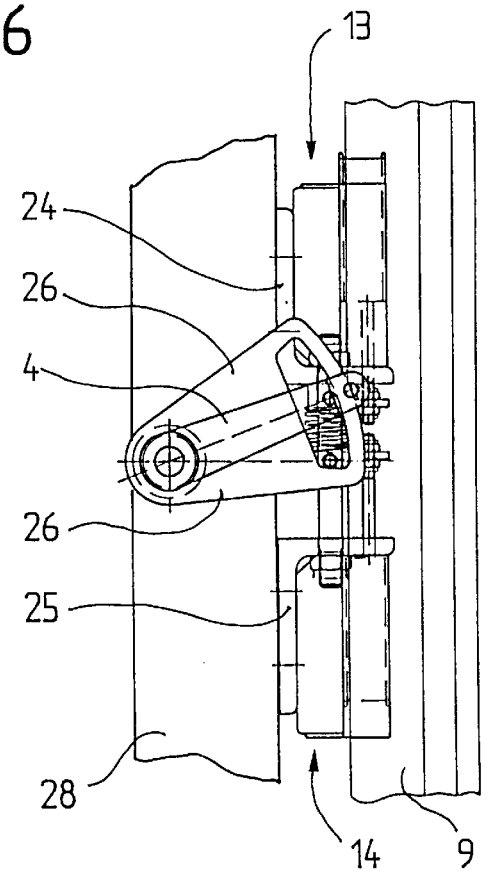
FIG. 6 shows the side elevation of the double arresting device in the triggered state in downward direction.
Figure 6A:
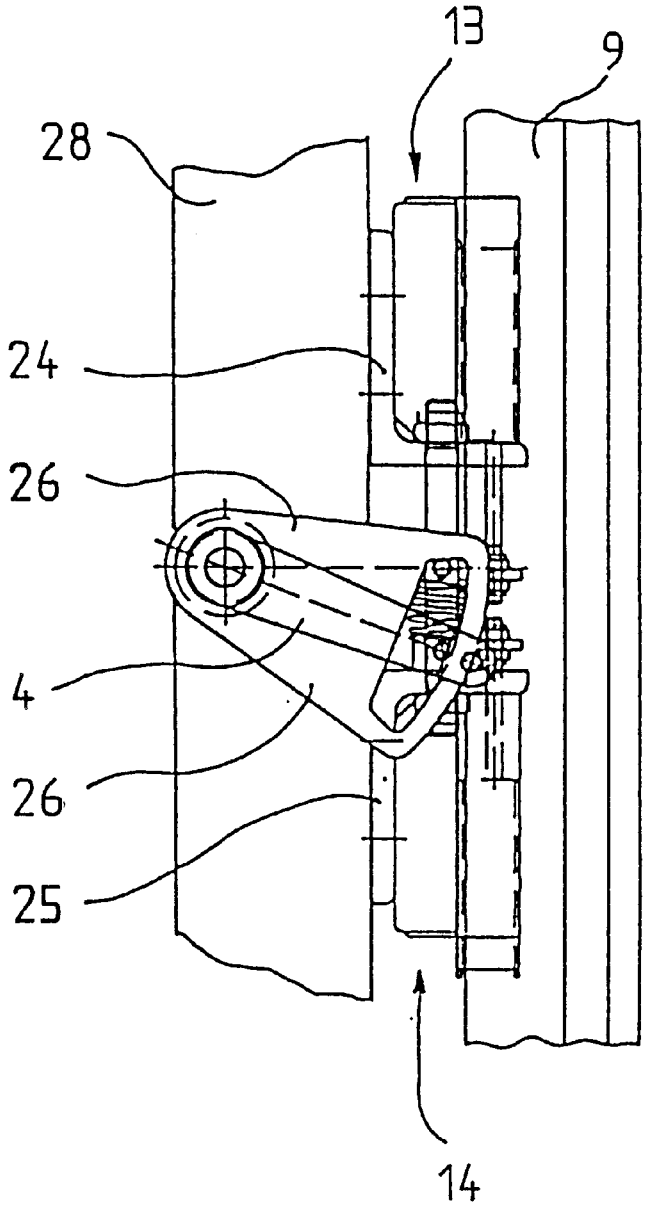
FIG. 6*a* shows the side elevation of the double arresting device in the triggered state in an upward direction.

The function and operation of the safety equipment may be more fully explained with reference to FIGS. 5, 6 and 6*a*. For example, in the following discussion, it is assumed that the elevator has exceeded the permissible speed of travel in the downward direction and speed limiter 1 has responded to the noted condition. Thus, the rotation of the cable wheel of speed limiter 1 and, therefore, the movement of limiter cable 2, may be blocked or retarded. Upon blocking (retarding) movement of limiter cable 2, trigger lever 4, which may be articulately coupled to limiter cable 2, may be pulled (rotated) upward by the still downward moving elevator (or downward by the upwardly moving elevator in the case of FIG. 6*a*). Simultaneously with the upward rotation of trigger lever 4, entraining plates 26 may also be rotated upwardly and recess 20 may entrain the entraining pins 27 associated with "down" entraining crosstie rod 17. That is, as entraining plate 26 is rotated upwardly, "down" entraining crosstie rod 17 may be forced upward, i.e., against the force of springs 15. It is noted that, as entraining plate 26 is rotated upward, the entraining pins 27 associated with "up" entraining crosstie 18 are not entrained (dragged) from the rest position. Further, on the outer sides of chocks 19, chock boxes 22 may be angled inwardly toward triggering shaft 23. Thus, as pullrods 21 are pulled (entrained), e.g., upward, chock box 22 guides the chocks toward each other and each chock toward guide rail 9. Thus, through pullrods 21, arresting chocks 19 may be drawn upwardly and inwardly until abutting guide 9. When arresting chocks 19 are moved into contact with guide 9, the elevator may be brought to a standstill with the shortest braking travel in accordance with regulations. During this exemplary arresting operation in the downward direction, the "up" arresting device 13 or the entraining pins 27 of the "up" crosstie rod 19, as noted above, were not actuated. Thus, the "up" arresting device 13 may remain in its functionally ready rest position during arresting in the downward direction. When the actuating "down" arresting device 14 has been cleared or corrected, arresting device 14 may be released by pulling up of the elevator cage and resetting speed limiter 1 to a functionally ready initial position. The safety equipment and elevator may then again be ready for function.

The resetting of a dropped-in arresting device 14 of 13 may be facilitated by a force exerted by restoring spring 15. With respect to elongated holes 31 in the lobes of the entraining crosstie rods, it should be noted that length of each elongated hole 31 should be selected to enable arresting chocks 19 and pullrods 21 to move horizontally from the rest position to an abutting position with guide 9. Further, the length should also consider certain wear of the arresting chocks and enable abutment with guide 9 to arrest movement of the elevator cage.

It is noted that known and existing arresting assemblies can be used in their conventional form for the double arresting device of the present invention with triggering equipment including, e.g., speed limiter 1, limiter cable 2 with tensioning weight 3, trigger lever 4, connecting rod 10, and arresting devices 13 and 14.

According to the present invention, the functionally opposite arrangement of arresting devices 13 and 14, support brackets 24 and 25 used for facilitating the opposite arrangement and for fastening and abutment, entraining crosstie rods 17 and 18 with entraining pins 27, guide pins 16 with restoring springs 15 and entraining plates 26 are a significant advancement over the prior art. The above-mentioned elements and arrangements may be incorporated functionally between the prior art to provide a significant advancement over the prior art.

Constructional details of the new parts are possible for the same function other than only in the shown and described form. Thus, for example, the entraining crosstie rods 17 and 18 can, with the same position of the elongated holes, have a wider shape without protruding lobes. In this sense, modified constructions fulfilling the same purpose are also possible for the further new parts.

Figure 7:
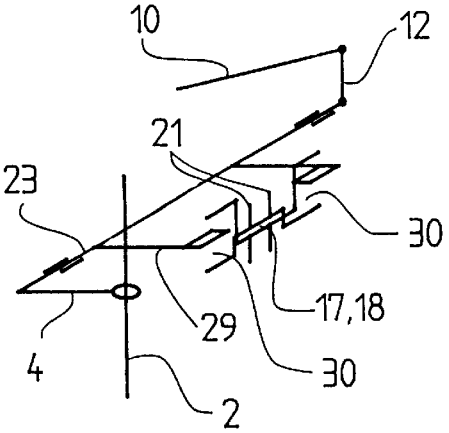
FIG. 7 shows a schematic illustration of a trigger variant.

In a further variation of the present invention, entraining plates 26 can include, for example, V-shaped double levers. Alternatively, entraining pins 27 could, as inversion of the triggering operative connection, be constructed together as entraining forks 30 and, in place of entraining plate 26, a simpler, forwardly bent-over lever 29 could engage into the entraining fork, as shown schematically in FIG. 7.

It is noted that the foregoing examples have been provided merely for the purpose of explanation and are in no way to be construed as limiting of the present invention. While the invention has been described with reference to a preferred embodiment, it is understood that the words which have been used herein are words of description and illustration, rather than words of limitation. Changes may be made, within the purview of the appended claims, as presently stated and as amended, without departing from the scope and spirit of the invention in its aspects. Although the invention has been described herein with reference to particular means, materials and embodiments, the invention is not intended to be limited to the particulars disclosed herein; rather, the invention extends to all functionally equivalent structures, methods and uses, such as are within the scope of the appended claims.

SAFETY EQUIPMENT

Parts List

1. speed limiter
2. limiter cable
3. tensioning weight
4. trigger lever
5. arresting device unit
6. arresting device unit
7. carrier cables
8. elevator cage
9. guide
10. connecting rod
11. guide rollers
12. connecting lever
13. "up" arresting device
14. "down" arresting device
15. restoring spring
16. guide pin
17. "down" entraining crosstie rod
18. "up" entraining crosstie rod
19. arresting chocks
20. recess
21. pullrod
22. chock box
23. triggering shaft
24. upper support bracket
25. lower support bracket
26. entraining plate
27. entraining pin

28. support profile section

29. angle lever

30. entraining fork

What is claimed:

1. Safety equipment for an elevator cage running along at least one guide rail, the safety device stopping the elevator cage when a predetermined speed of travel in one of an upward and downward direction of travel is exceeded, the safety equipment comprising:

a trigger lever coupled to a limiter cable, the limiter cable operable in each direction of travel;

at least one double arresting device coupled to the elevator cage including a first and second arresting device, the first and second arresting device operable in mutually opposite directions of travel;

a first and second fastening part respectively associated with each at least one first and second arresting device;

the trigger lever coupled to the at least one double arresting device actuatable by a predetermined relative movement between the elevator cage and the limiter cable; and triggering devices coupled between the trigger lever and the first and second arresting devices, the triggering devices actuating one of the first and second arresting device in accordance with actuation of the trigger lever, the triggering devices comprising a first and a second entraining plate coupled for synchronous movement with the trigger lever, wherein the triggering devices actuate one of the first and second arresting devices in a direction substantially perpendicular to a direction of movement for actuating the trigger lever.

2. The safety equipment according to claim 1, each fastening part comprising an L-shaped member having a first arm coupled to the elevator cage and a second arm for guiding one of the first and second arresting devices toward the guide rail to stop the movement of the elevator cage.

3. Safety equipment for an elevator cage running along at least one guide rail, the safety device stopping the elevator cage when a predetermined speed of travel in one of an upward and downward direction of travel is exceeded, the safety equipment comprising:

a trigger lever coupled to a limiter cable, the limiter cable operable in each direction of travel;

at least one double arresting device coupled to the elevator cage including a first and second arresting device, the first and second arresting device operable in mutually opposite directions of travel;

a first and second fastening part respectively associated with each at least one first and second arresting device;

the trigger lever coupled to the at least one double arresting device actuatable by a predetermined relative movement between the elevator cage and the limiter cable; and triggering devices coupled between the trigger lever and the first and second arresting devices, the triggering devices actuating one of the first and second arresting device in accordance with actuation of the trigger lever;

the triggering devices comprising:

a first and second entraining plate;

a first and second entraining crosstie rod, each entraining rod including a first and second end having an entraining pin;

each entraining pin in engagement with one of the first and second entraining plate; and at least two guide pins and respective restoring springs coupled between an arm of the first and second fastening parts.

4. The safety equipment according to claim 3, each entraining plate comprising a recess having an annular segment shape that enables triggering of one of the first and second triggering devices in accordance with the direction of travel while enabling the non-triggered one of the first and second triggering devices to remain at a rest position.

5. Safety equipment for an elevator cage running along at least one guide rail, the safety device stopping the elevator cage when a predetermined speed of travel in one of an upward and downward direction of travel is exceeded, the safety equipment comprising:

a trigger lever coupled to a limiter cable, the limiter cable operable in each direction of travel;

at least one double arresting device coupled to the elevator cage including a first and second arresting device, the first and second arresting device operable in mutually opposite directions of travel;

a first and second fastening part respectively associated with each at least one first and second arresting device;

the trigger lever coupled to the at least one double arresting device actuatable by a predetermined relative movement between the elevator cage and the limiter cable;

triggering devices coupled between the trigger lever and the first and second arresting devices, the triggering devices actuating one of the first and second arresting device in accordance with actuation of the trigger lever;

a first and second entraining crosstie rod having first and second ends;

a first and second pullrod;

a first and second brake chock, the first and second brake chocks being associated with a respective first and second pullrod;

a first and second entraining plate;

a recess formed in each of the first and second entraining plates; and an entraining pin positioned at each first and second end of each first and second entraining crosstie rod.

6. The safety equipment according to claim 5, the first and second entraining crosstie rods are biased toward a rest position through at least one restoring spring and a guide pin.

7. Safety device for arresting movement of an elevator cage when a speed of the elevator cage exceeds a predetermined limit, the elevator cage speed monitored with respect to a limiter cable, said safety equipment comprising:

a first and second arresting device, said first and second arresting device positioned for arresting movement of the elevator cage in a respective first and second direction of travel;

a triggering device that actuates one of said first and second arresting device;

a trigger lever that actuates said triggering device in response to a predetermined relative movement between the elevator cage and the limiter cable; and said triggering device, comprising a first and second entraining crosstie, which when actuated, forces said first and second entraining crossties relatively closer together, said relative closer movement of said first and second entraining crossties directing one of said first and second arresting device to arrest movement of the elevator cage.

8. The safety device according to claim 7, each said first and second arresting devices comprising a first and second arresting chock; and said relative closer movement of the first and second entraining crossties directing the first and second arresting chocks of one of said first and second arresting device to move in two dimensions.

9. The safety device according to claim 8, each said first and second arresting devices further comprising a first and second fastening bracket that respectively fastens said first and second arresting devices to the elevator cage; and each fastening bracket includes a first and second elongated hole that guides the movement of said first and second arresting chocks.

10. The safety device according to claim 7, said triggering device further comprising a first and second entraining plate, said first and second entraining plates being immobile relative to each other and relative to said trigger lever.

11. The safety device according to claim 10, said triggering device further comprising a triggering shaft, said trigger lever and said first and second entraining plates being mounted on said triggering shaft.

12. The safety device according to claim 10, each said first and second entraining crosstie comprising a first and second end, each said first and second end comprising an entraining pin;

each said first and second entraining plate receiving one of said entraining pins from each of said first and second entraining crossties;

movement of said first and second entraining plates correspondingly moves one of said first and second entraining crosstie.

13. The safety device according to claim 12, each said entraining plate comprising a recess for receiving said entraining pins;

wherein movement of said first and second entraining plates in a first direction actuates said second arresting device and movement of said first and second entraining plates in a second direction actuates said first arresting device.

14. The safety device according to claim 7, said first and second entraining crossties parallelly mounted for movement relative to each other.

15. The safety device according to claim 14, further comprising a first and second fastening member parallelly mounted and immobile with respect to each other; and said first and second fastening members parallelly mounted for parallel movement relative to an actuated one of said first and second entraining crossties in response to actuation of said trigger lever.

16. The safety device according to claim 15, each said first and second arresting device further comprising a first and second arresting chock;

said parallel relative movement guiding said first and second arresting chocks associated with said actuated one in a direction opposite said direction of travel.

17. The safety device according to claim 15, each said first and second arresting device further comprising a first and second arresting chock;

said parallel relative movement guiding said first and second arresting chocks associated with said actuated one in a direction toward each other.

18. The safety device according to claim 17, further comprising:

a third and fourth arresting device positioned for arresting movement of the elevator cage in said respective first and second directions and positioned to respectively face said first and second arresting devices; and a connecting rod that couples said first and second arresting devices to said third and fourth arresting devices such that actuation of said first arresting device substantially simultaneously actuates said third arresting device and that actuation of said second arresting device substantially simultaneously actuates said fourth arresting device.

19. Safety device for arresting movement of an elevator cage when a speed of the elevator cage exceeds a predetermined limit, the elevator cage speed monitored with respect to a limiter cable, said safety equipment comprising:

a first and second arresting device, said first and second arresting device positioned for arresting movement of the elevator cage in a respective first and second direction of travel;

a triggering device that actuates one of said first and second arresting device;

a trigger lever that actuates said triggering device in response to a predetermined relative movement between the elevator cage and the limiter cable;

said triggering device, comprising a first and second entraining crosstie, which when actuated, forces said first and second entraining crossties relatively closer together, said relative closer movement of said first and second entraining crossties directing one of said first and second arresting device to arrest movement of the elevator cage;

each said first and second arresting devices comprising a first and second arresting chock;

said relative closer movement of the first and second entraining crossties directing the first and second arresting chocks of one of said first and second arresting device to move in two dimensions;

each said first and second arresting devices further comprising a first and second fastening bracket that respectively fastens said first and second arresting devices to the elevator cage;

each fastening bracket includes a first and second elongated hole that guides the movement of said first and second arresting chocks;

each said fastening bracket comprising an L-shaped bracket in which a vertical arm of said L-shaped bracket is coupled to the elevator cage and in which a horizontal arm of said L-shaped bracket includes said first and second elongated holes;

each said first and second arresting device further comprising a first and second pullrod respectively associated with said first and second arresting chock; and said first and second elongated holes of an actuated one of said first and second arresting device respectively guiding said movement in two dimensions of said first and second pullrod in a direction one of toward and away from each other and in a direction parallel to each other.

20. Safety device for arresting movement of an elevator cage when a speed of the elevator cage exceeds a predetermined limit, the elevator cage speed monitored with respect to a limiter cable, said safety equipment comprising:

a first and second arresting device, said first and second arresting device positioned for arresting movement of the elevator cage in a respective first and second direction of travel;

a triggering device that actuates one of said first and second arresting device;

a trigger lever that actuates said triggering device in response to a predetermined relative movement between the elevator cage and the limiter cable;

said triggering device, comprising a first and second entraining crosstie, which when actuated, forces said first and second entraining crossties relatively closer together, said relative closer movement of said first and second entraining crossties directing one of said first and second arresting device to arrest movement of the elevator cage;

each said first and second arresting devices comprising a first and second arresting chock;

said relative closer movement of the first and second entraining crossties directing the first and second arresting chocks of one of said first and second arresting device to move in two dimensions;

said trigger lever being actuatable in one of a first and a second direction, wherein the one of the first and second direction is opposite a direction of movement of the elevator cage;

said one of two dimensions of movement for the first and second arresting chocks comprising the one of the first and second direction; and an other of said two dimensions of movement for the first and second arresting chocks comprising a direction in which said first and second arresting chocks are moved one of relatively closer to each other and further apart from each other.

21. The safety equipment according to claim 3, the first and second entraining plates comprising annular segment shapes and a recess positioned along an outer rim of the annular segment shapes, wherein the recess extends over approximately 90% of the annular segment angle.

* * * * *